US009659571B2

(12) United States Patent
Van Der Schaar et al.

(10) Patent No.: US 9,659,571 B2
(45) Date of Patent: May 23, 2017

(54) SYSTEM AND METHOD FOR EMITTING AND ESPECIALLY CONTROLLING AN AUDIO SIGNAL IN AN ENVIRONMENT USING AN OBJECTIVE INTELLIGIBILITY MEASURE

(75) Inventors: Hans Van Der Schaar, EB Breda (NL); Oosterom Han, MH Delft (NL); Richard Heusdens, EA Dirkshorn (NL); Richard Hendriks, CG Vlaardingen (NL)

(73) Assignee: Robert Bosch GmbH, Stuttgart (DE)

( * ) Notice: Subject to any disclaimer, the term of this patent is extended or adjusted under 35 U.S.C. 154(b) by 287 days.

(21) Appl. No.: 14/116,995

(22) PCT Filed: May 11, 2011

(86) PCT No.: PCT/EP2011/057622

§ 371 (c)(1),
(2), (4) Date: Jan. 10, 2014

(87) PCT Pub. No.: WO2012/152323

PCT Pub. Date: Nov. 15, 2012

(65) Prior Publication Data

US 2014/0126728 A1 May 8, 2014

(51) Int. Cl.

| | |
|---|---|
| ***G10L 21/02*** | (2013.01) |
| ***H04R 29/00*** | (2006.01) |
| ***G08B 3/10*** | (2006.01) |

(52) U.S. Cl.

CPC ..... *G10L 21/02* (2013.01); *G08B 3/10* (2013.01); *H04R 29/00* (2013.01); *H04R 29/007* (2013.01); *H04R 2227/009* (2013.01)

(58) Field of Classification Search

None

See application file for complete search history.

(56) References Cited

U.S. PATENT DOCUMENTS 5,434,922 A 7/1995 Miller et al.
5,459,813 A * 10/1995 Klayman ..... G10L 21/0364 381/82

(Continued)

FOREIGN PATENT DOCUMENTS

| | | |
|---|---|---|
| DE | 102007031064 | 6/2008 |
| EP | 1808853 | 7/2007 |

OTHER PUBLICATIONS

Hersch, Rudolf. English translation of DE102007031064. "Emergency device for electro acoustic emergency warning system, has microphone mounted in loudspeakers to measure acoustic pressure of individual loudspeakers, where loud speaker operating analog signal is compared with radiated signal" pp. 1-17.*

(Continued)

*Primary Examiner* — Curtis Kuntz
*Assistant Examiner* — Qin Zhu
(74) *Attorney, Agent, or Firm* — Michael Best & Friedrich LLP

(57) ABSTRACT

Public address systems or other systems for emitting audio signals, like music, speech or announcements, in different locations like supermarkets, schools, universities, and auditoriums are widely known. In one embodiment, invention proposes a system for emitting an audio signal in an environment. The system includes an audio source for providing the audio signal and at least one loudspeaker for emitting the audio signal. The system also includes at least one microphone for receiving an acoustic signal from the environment. The acoustic signal is based on the audio signal and may comprise disturbing components. The system also includes an analyzing module for analyzing the acoustic signal and for providing an intelligibility measure from an objective intelligibility measure method. The intelligibility measure is used as a feedback signal.

20 Claims, 3 Drawing Sheets

(56) References Cited

U.S. PATENT DOCUMENTS 6,201,960 B1 * 3/2001 Minde et al. ..... H04W 24/00 455/424
7,660,716 B1 * 2/2010 Cohen et al. ..... G10L 25/69 704/208
7,702,112 B2 * 4/2010 Obranovich et al. .. G08B 29/10 367/136
2002/0184027 A1 * 12/2002 Brittan et al. ..... G10L 13/047 704/258
2002/0188442 A1 * 12/2002 Gass et al. ..... G10L 25/78 704/208
2005/0135637 A1 6/2005 Obranovich et al.
2005/0216263 A1 * 9/2005 Obranovich ..... G08B 29/10 704/233
2007/0147625 A1 6/2007 Shields et al.
2008/0219458 A1 * 9/2008 Brooks ..... H03G 3/32 381/57
2009/0012794 A1 1/2009 Van Wijngaarden et al.
2009/0281800 A1 * 11/2009 LeBlanc et al. .... G10L 21/0208 704/224
2009/0319268 A1 * 12/2009 Aumont ..... G10L 25/69 704/236
2012/0263317 A1 * 10/2012 Shin et al. ..... G10L 21/0224 381/94.7
2013/0185078 A1 * 7/2013 Tzirkel-Hancock et al. ..... G10L 15/22 704/275

OTHER PUBLICATIONS

Taal et al, "Intelligibility Prediction of Single-Channel Noise-Reduced Speech," in ITG-Fachtagung Sprachkommunikation—Oct. 8, 2010 in Bochum, Germany, 4 pages.

Taal et al., "A short-time objective intelligibility measure for time-frequency weighted noisy speech," in International Conference on Acoustics Speech and Signal Processing (ICASSP), 2010 IEEE, pp. 4214-4217.

International Search Report for Application No. PCT/EP2011/057622 dated Jan. 26, 2013 (2 pages).

* cited by examiner

SYSTEM AND METHOD FOR EMITTING AND ESPECIALLY CONTROLLING AN AUDIO SIGNAL IN AN ENVIRONMENT USING AN OBJECTIVE INTELLIGIBILITY MEASURE

BACKGROUND OF THE INVENTION

The invention relates to a system and a method for emitting an audio signal in an environment. More specifically the invention relates to a system for emitting an audio signal in an environment, the system comprising: an audio source for providing the audio signal, at least one loudspeaker for emitting the audio signal, and at least one microphone for receiving an acoustic signal from the environment, whereby the acoustic signal is based on the audio signal and may comprise disturbing components. The invention also relates to a method using the system.

Public address systems or other systems for emitting audio signals, like music, speech or announcements, in different locations like supermarkets, schools, universities, auditoriums are widely known. These systems usually comprise an audio source, for example a microphone or a recorder, and a plurality of loudspeakers, which are locally distributed in the locations, for emitting the audio signal from the audio source.

In simple embodiments, these systems have an adjustable amplification, so that the volume of the audio signal emitted by the loudspeakers can be adjusted to a desired value. In more sophisticated systems, the amplification is made dependent from the noise and other disturbing components in the locations. In some of these systems a signal to noise ratio (SNR) is calculated, which is often determined as the quotient: (amplified output)/(sensed ambient signal-amplified output), whereby the sensed ambient signal may be detected by a microphone in the locations. Such an approach is for example disclosed in the document U.S. Pat. No. 5,434,922 A in the connection of a radio for an automobile.

Document EP 1 808 853 A 1, probably representing the closest prior art, discloses a public address system which compares a wanted audio signal with a disturbing audio signal and calculates an amplification factor for amplifying the audio signal.

SUMMARY OF THE INVENTION

According to the invention a system for emitting an audio signal in an environment, especially in an acoustic environment is disclosed. The system may be realized as a small-scaled, for example handheld system like a mobile phone, a personal digital assistant (pda) a tablet-computer etc. It may be realized as a mid-scaled or private system like a car or home stereo, television set etc. Preferably the system is a large-scaled or public system like a public address system etc.

Accordingly, the environment may—for example—be the adjacent or close-by surrounding area for the small-scaled system, a room or the interior space of a vehicle for the mid-scaled system. In case of the large-scaled system it is also possible that the system provides the audio signal for a conference room or conference hall as the environment or for a plurality of rooms as a plurality of environments.

The audio signal is preferably realized as an information carrying signal addressed to persons staying in the environment or using the environment. The information carried by the audio signal is especially a spoken information and is for example embodied as an announcement, a message or as a speech. In another embodiment of the invention the information carried by the audio signal is music or a combination of music and spoken information.

The audio source may be realized as an audio signal generating unit, for example a microphone, especially a transducer, or as an audio signal reproducing unit, for example a recorder or a computer, which outputs computer spoken audio signals. Optionally the audio source is coupled to an amplifier and/or a damping unit for amplifying or damping the audio signal.

The system further comprises at least one loudspeaker, which emits the audio signal in the environment. In case of the small-scaled systems, only one loudspeaker or loudspeaker arrangement may be present, in case of the mid-scaled systems, a plurality of loudspeaker may be distributed in the room or interior space. In case of the large-scaled systems, at least one loudspeaker is arranged in each room, which is provided by the system with the audio signal, so that the system may comprise a plurality of loudspeakers, which are locally distributed.

At least one microphone is provided for receiving an acoustic signal from the environment. The microphone may be realized as any kind of a transducer, which converts the acoustic signal in an electric signal. The acoustic signal is based on the audio signal, especially comprises the audio signal or at least parts or fragments of the audio signal. Disturbing components of the acoustic signal are based on echoes, transmission errors, reverberations and/or noise in the environment or are resulting from the system itself.

According to the invention, the system comprises an analyzing module, which is adapted or operable to analyze the acoustic signal. During the analyzing step, an objective intelligibility measure is performed, as a result from the analyzing step or from the objective intelligibility measure method an intelligibility measure is derived or calculated or estimated. The intelligibility measure is defined as a characteristic of how comprehendible the information, especially the speech or announcement, inserted by the audio signal in the acoustic signal is.

The intelligibility measure is preferably a value, especially a time dependent value or a plurality of values, for example a vector or matrix of values, especially a plurality of time dependent values. A plurality of values is for example advantageous in case a plurality of different environments, for example rooms, shall be controlled independently or separately from each other, so that for each environment one value is provided. It is also possible that the intelligibility measure is frequency dependent, so that a plurality of values is provided for one acoustic signal from one location, whereby the plurality of intelligibility values refer to different frequencies or different frequency bands of the acoustic signal.

The intelligibility measure may for example be derived by one of the following objective intelligibility measure methods:

AI Artificial Index,
SII Speech-Intelligibility index (ANSI S3.5-1997)
STI Speech transmission Index
SSR Segmental SNR
LLR Log-Likelihood Ratio
IS Itakura-Saito
CEP Cepstral Distance Measure
WSS Weighted-Spectral Slope Metric
FWS Normalized Frequency Weighted SSNR
PESQ PESQ
DAU Dau auditory model
CSII Coherence SII CSTI Covariance based STI STOI Short-time Objective Intelligibility Measure References for the above-mentioned objective intelligibility measure methods can be found in the scientific paper from Cees Taal, Richard Hendriks, Richard Heusdens, Jesper Jensen: Intelligibility Prediction of Single-Channel NoiseReduced Speech; in ITG-Fachtagung Sprachkommunikation • 6-8, Oct. 2010 in Bochum, Germany (ISBN 978-3-8007-3300-2), which is incorporated by reference in its entirety.

The intelligibility measure is used as a feedback signal in the system. As explained in the following, the feedback signal may for example be coupled back to the system in order to improve or control the intelligibility of the acoustic signal or to protocol the intelligibility measure for example as a proof or a look-up table or to start other reactions of the systems like repeating the audio signal in order to improve the intelligibility. Additionally or alternatively the feedback signal may be coupled back in an indicating unit of the system, indicating a call operator or a speaker that the audio signal was emitted for example with a bad intelligibility.

The system according to the invention shows various advantages: The setup of the system is easy, because a setting of the desired intelligibility measure or range is almost sufficient. The intelligibility measure as a feedback signal is an expressive value and a direct measure for the performance of the system, because it is in general the main goal of a system for emitting an audio signal in an environment that the audio signal is intelligible and not for example whether or not the signal to noise ratio is kept at a certain level.

In a preferred embodiment of the invention, the analyzing module or the system itself works in real-time, so that the feedback signal is also coupled back in real-time. Real-time in the connection of the system means that the intelligibility measure is provided with a small delay for example smaller than 2 s, preferably smaller than 1 s and especially smaller than 0.5 s. This embodiment has the advantage, that a reaction of the system or of the call operator or of the speaker can also be provided promptly or also in real-time. This embodiment is the basis for example for a system, which adapts the audio signal in real-time in dependence from the intelligibility measure.

The main application of the system can be found in the transmission of spoken information, like an announcement, a message or a speech etc. Therefore it is preferred that the intelligibility measure is a measure for the speech intelligibility of the acoustic signal. Various possibilities for deriving the intelligibility measure, especially the speech intelligibility measure, are listed above. In alternative embodiments, the system can provide a intelligibility measure for music, so that the system cares about the intelligibility of music, for example in a concert hall or in a car.

In a preferred embodiment of the invention, the analyzing module is operable to compare the audio signal as a clean signal with the acoustic signal as a noisy signal to derive the intelligibility measure of the acoustic signal. In order to improve the result, it is preferred that the two signals are time-aligned prior to the comparison.

In a practical realization, the objective intelligibility measure is based on the STOI—Short-time Objective Intelligibility Measure as disclosed for example in the scientific paper Cees H. Taal, Richard C. Hendriks, Richard Heusdens, Jesper Jensen: a short-time objective intelligibility measure for time-frequency weighted noisy speech; in International Conference on Acoustics Speech and Signal Processing (ICASSP), 2010 IEEE, ISBN: 978-1-4244-4295-9, which is incorporated by reference in its entirety. Especially, the objective intelligibility measure is based on the comparison of the frequency distribution of the time aligned audio signal and the acoustic signal during a short time period, for example shorter than 1 s, especially shorter than 0.5 s.

In a preferred embodiment, the system comprises an automatic volume control with a control loop, which is adapted to control the volume (or energy) of the audio signal emitted by the at least one loudspeaker, whereby the intelligibility measure is used as the feedback signal in the control loop. In this embodiment a intelligibility measure based automatic volume control is proposed. The volume may be controlled by using a gain or an amplification factor of an amplifier as an actuating variable. The control loop may for example be realized as a closed-loop control, but also other control strategies like fuzzy logic etc. are possible. The advantage of this embodiment is, that the system will keep the intelligibility, especially the speech intelligibility of the acoustic signal according to a predefined set-point or range, and thus secures that all acoustic signals are intelligible. Especially in case of using the analyzing module in a real-time mode, the system can react instantaneously on for example rises of the background noise, without destabilizing the system.

In a development of the invention, the analyzing module is operable to provide the intelligibility measure for at least two or a plurality of frequency bands of the acoustic signal, whereby for each of the frequency bands an intelligibility value is calculated. Furthermore the automatic volume control uses the at least two intelligibility values for controlling the volumes of the frequency bands of the audio signal separately and/or independently from each other. This development allows the system to adapt the volume in different frequency bands separately in order to compensate for noise sources in certain frequency ranges.

In a possible realization of this development, the automatic volume control is adapted to keep the overall energy or volume in the environment of the emitted audio signal constant or within a pre-defined range. In this realization, the system allows to keep the overall energy or volume constant while maintaining a pre-defined intelligibility. For example in case the intelligibility of a first frequency band is high and the intelligibility of a second frequency band is low, the volume of the first frequency band is reduced and the volume of the second frequency band is increased, so that the intelligibility of all frequency bands is sufficient or a above a pre-defined level and the overall volume is kept constant or at least kept within desired or pre-defined ranges.

In a further preferred embodiment, the system comprises a repeating module, which is adapted to repeat the same audio signal or another, substituting audio signal in case the intelligibility measure is worse than a pre-defined value or threshold. In this case the feedback signal is used as a basis for a decision whether or not the audio signal must be emitted a further time.

In yet a further possible embodiment, the system may comprise a protocol module, which is operable to protocol the intelligibility measure of the acoustic signal. In this embodiment the feedback signal is used to protocol whether or not the audio/acoustic signal was intelligible for the persons in the environment. The protocol derived from the protocol module may hold meta-data about the audio signal, time of broadcasting or emission of the audio signal, the location of the broadcasting or emission of the audio signal in the environment and the intelligibility measure. This protocol may for example beneficially be used as a proof or an evidence that a certain audio signal was intelligibly emitted in a certain area.

In yet a further embodiment of the invention, an information module is provided, which is adapted to inform a user of the system of the intelligibility measure or a representative or an equivalent thereof. The information module may for example comprise visual indicators like traffic lights, indicating whether or not a just emitted audio signal was intelligible or not. In case the audio signal was not intelligibly emitted, the user has the possibility to react and—for example—may repeat the audio signal. In case the information module indicates that the audio signal was intelligibly emitted, the user will receive a positive confirmation.

In a practical realization the system is embodied as a public address system or as a sound reinforcement system comprising a plurality of loudspeakers as described above.

In a possible embodiment, the system, especially the public address system comprises a speaker unit with a transducer or a microphone and visual indicators indicating whether or not a just emitted audio signal was intelligible or not. A further subject-matter of the invention is a method for controlling, correcting and/or indicating the intelligibility measure of an audio signal generated by the system as described above, whereby the intelligibility measure is used as a feedback signal in the system.

BRIEF DESCRIPTION OF THE DRAWINGS

Further effects, features and advantages will become apparent by the description of preferred embodiments of the invention and the figures as attached. The figures show.

DETAILED DESCRIPTION

Figure 1:
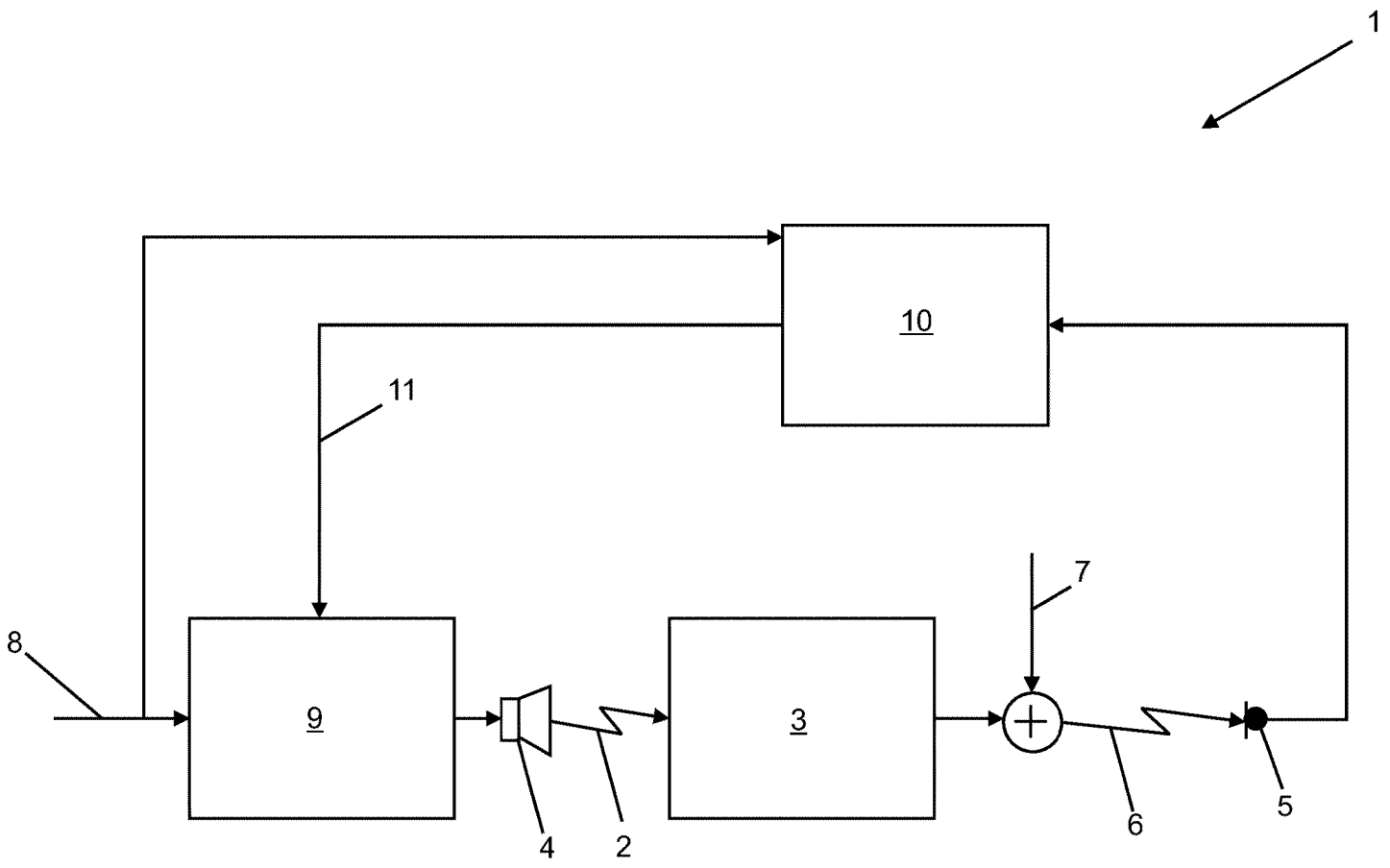
FIG. 1 a block diagram of a system for emitting an audio signal in an environment as an embodiment of the invention.

FIG. 1 is a block diagram illustrating a system 1 for emitting an amplified audio signal 2 in an environment 3. The system 1 comprises at least one loudspeaker 4 for emitting the amplified audio signal 2 into the acoustic environment 3 and at least one microphone 5 for receiving an acoustic signal 6 from said acoustic environment 3. The acoustic signal 6 comprises parts of the emitted audio signal 2 and furthermore disturbing components from the environment 3 like echo reverberations and additionally noise 7, which may result from the environment 3 or from the system 1 itself like amplifier noise etc. The system 1 further comprises or is coupled to audio signal generating means (not shown) for example a recorder or a microphone for a speaker, which generate the un-amplified or original audio signal 8. The audio signal 8 is amplified by an amplifier 9.

In this embodiment, the system 1 is realized as a public address system or a sound reinforcement system, which could comprise a plurality of loudspeakers 4 and also a plurality of microphones 5. Such an public address system can be used in schools, supermarkets or other places, whereby a plurality of acoustic environments 3 are formed in which at least one loudspeaker 4 and one microphone 5 is arranged. Such an acoustic environment 3 may be realized as room, for example a class room.

As indicated in FIG. 1, the acoustic signal 6 (converted into an electric signal) is guided into a control module 10, which will be explained in connection with FIG. 2. Furthermore the original audio signal 8 is guided into the control module 10. As an output, the control module 10 comprises a gain signal 11 path to the amplifier 9, so that the control module 10 is operable to control the gain of the amplifier 9 and thus the volume of the amplified audio signal 2.

Figure 2:
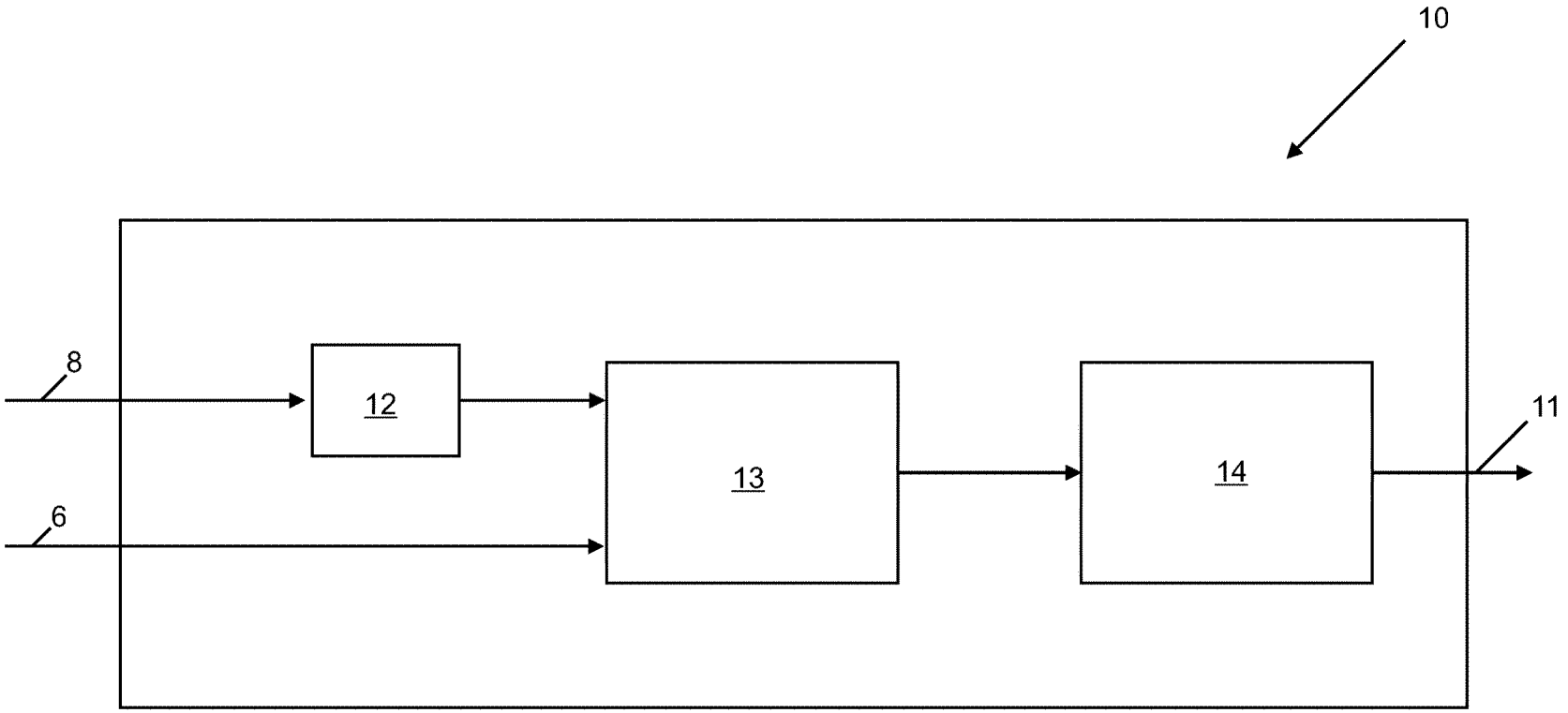
FIG. 2 a block diagram of the control module of the system in FIG. 1.

FIG. 2 illustrates the components of the control module 10, which shows two inputs for receiving the audio signal 8 and the acoustic signal 6 and one output for sending the gain signal 11 to the amplifier 9. In a first step, the audio signal 8 is delayed by a delay unit 12 in order to be time-aligned with the acoustic signal 6. The time delay between the audio signal 8 and the acoustic signal 6 results from different lengths of the signal paths and may be eliminated or compensated as described or by another way. The two signals 6 and 8 are transferred to an analyzing module 13, which is adapted to analyze the two signals 6 and 8 and to provide an intelligibility measure from an objective intelligibility measure.

The objective intelligibility measure method used in the analyzing module 13 preferably shows a low complexity with high correlation to the subjective speech intelligibility of the acoustic signal 6.

EXAMPLE

The method proposed as an example is a function of the clean and processed speech, denoted by x and y, respectively, which corresponds to the audio signal 8 and the acoustic signal 6. The model is designed for a sample-rate of 10000 Hz, in order to cover the relevant frequency range for speech-intelligibility. Any signals at other sample-rates should be re-sampled. Furthermore, it is assumed that the clean and the processed signal are both time-aligned, for example by the delay unit 12. First, a TF-representation (Time Frequency) is obtained by segmenting both signals into 50% overlapping, Hanning-windowed frames with a length of 256 samples, where each frame is zero-padded up to 512 samples and Fourier transformed. Then, an one-third octave band analysis is performed by grouping OFT-bins. In total 15 one-third octave bands are used, where the lowest center frequency is set equal to 150 Hz. Let $\hat{x}$ (k,m) denote the $k^{th}$ DFT-bin of the $m^{th}$ frame of the clean speech. The norm of the $j^{th}$ one-third octave band, referred to as a TF-unit, is then defined as, $$X_j(m) = \sqrt{\sum_{k=k_1(j)}^{k_2(j)-1} |\hat{x}(k, m)|^2}$$

where k1 and k2 denote the one-third octave band edges, which are rounded to the nearest DFT-bin. The TF-representation of the processed speech is obtained similarly, and will be denoted by Yj (m). The intermediate intelligibility measure for one TF-unit, say dj (m), depends on a region of N consecutive TF-units from both Xj (n) and Yj (n), where nEM and M={(m−N+1), (m−N+2), . . . , m−1, m}. First, a local normalization procedure is applied, by scaling all the TF-units from Yj (n) with a factor $$\alpha=(\Sigma_n X_j(n)^2/\Sigma_n Y_j(n)^2)^{j+2}$$

such that its energy equals the clean speech energy, within that TF-region. Then, αYj (n) is clipped in order to lower bound the signal-to-distortion ratio (SDR), which we define as, $$SDR_j(n) = 10log_{10}\left(\frac{X_j(n)^2}{(\alpha Y_j(n) - X_j(n))^2}\right)$$

Hence $$Y'=\max(\min(\alpha Y,X+10^{-\beta/20}X),X-10^{-\beta/20}X),$$

where Y' represents the normalized and clipped TF-unit and β denotes the lower SDR bound. The frame and one-third octave band indices are omitted for notational convenience. The intermediate intelligibility measure is defined as an estimate of the linear correlation coefficient between the clean and modified processed TF-units, $$d_j(m) = \frac{\sum_n \left(X_j(n) - \frac{1}{N}\sum_l X_j(l)\right)\left(Y'_j(n) - \frac{1}{N}\sum_l Y'_j(l)\right)}{\sqrt{\sum_n \left(X_j(n) - \frac{1}{N}\sum_l X_j(l)\right)^2 \sum_n \left(Y'_j(n) - \frac{1}{N}\sum_l Y'_j(l)\right)^2}}$$

where I E M. Finally, the eventual OIM is simply given by the average of the intermediate intelligibility measure over all bands and frames, $$d = \frac{1}{JM}\sum_{j,m} d_j(m),$$

where M represents the total number of frames and J the number of one-third octave bands. Maximum correlation is obtained with β=15 and N=30, which means that the intermediate measure depends on speech information from the last 384 ms. The delay for providing the intelligibility measure is about 400 ms and is thus provided in real-time.

The OIM as an example of an intelligibility measure or a similar value from another objective intelligibility measure method is transferred to an automatic volume control 14 as a feedback signal, which compares the intelligibility measure to certain thresholds to determine whether the gain of the amplifier 9 has to be increased, decreased or kept constant to maintain a predefined intelligibility measure. The gain is upper- and lower-bounded to certain predetermined levels. The control module 10 or the automatic volume control 14 may detect silences in speech of the audio signal 8. During short pauses the gain is frozen and during long pauses, after the echo has died out, the noise level is directly detected and this is translated in a suitable gain, for when the system 1 restarts transmitting a message.

The main advantages, which can be reached with the invention are as follows: Firstly its simplicity, no extensive setup has to be completed on installation, a simple setting of the desired intelligibility or intelligibility range or measure and the initial acoustical delay to the microphone 5 will do. Because the acoustics of the room do not have to be modeled this system 1 is suitable for any space. The computational complexity is also drastically reduced if the right Objective Intelligibility measure method is chosen. This system 1 can react instantaneously on rises in the background noise, without destabilizing the system. But the main advantage is that there is a direct feedback to the system 1 or the call operator on the intelligibility of the conveyed message. If the intelligibility (measure) is low the gain has to be increased. Known systems generally adapt on the measured signal to noise ratio, this is however not always a good measure of the intelligibility of a message. Making sure that the message was intelligible is in general the main goal of a public address system and not whether the signal to noise ratio is kept at a certain level.

Figure 3:
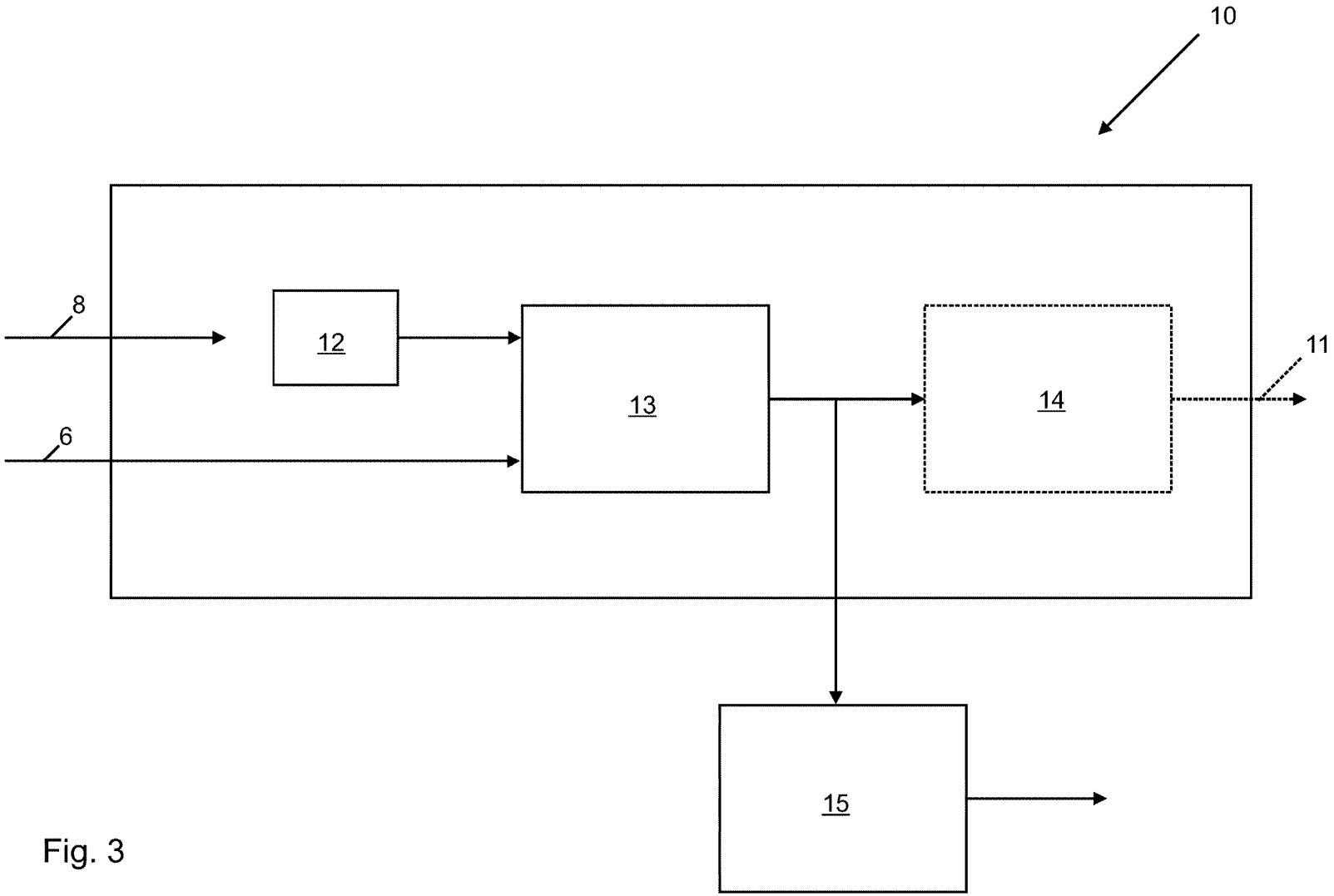
FIG. 3 a block diagram of the control module of FIG. 2 in another embodiment.

FIG. 3 illustrates a possible modification of the control module 10 in FIG. 2. In the modification, the intelligibility measure is coupled back into an processing module 15. The processing module 15 may be provided additionally or alternatively to the automatic volume control 14.

In a first embodiment, the processing module 15 is realized as a repeating module, which is adapted to repeat the audio signal 2 in case the intelligibility measure as a feedback signal is worse than a pre-defined value or threshold. This embodiment can be used in case the system 1 provides announcements or messages in the acoustic environment 3. In case the announcement was not intelligible, the announcement is repeated automatically or another substituting announcement is provided.

For example the measured intelligibility is analyzed in a number of frames during a message or announcement. If too many consecutive frames, or too many frames on average are classified as being unintelligible or having low intelligibility the repeating module could give of a warning to the system 1 or to the call operator that the message or announcement might not have intelligible to all the listeners and that the message should be repeated.

In a second embodiment, the processing module 15 is realized as a protocol module, which uses the intelligibility measure as a feedback signal to protocol the intelligibility of the emitted audio signals 8. In some applications it is important to know whether or not an announcement was intelligible or not. In order to have a proof for the intelligibility, the protocol module provides a journal as it is known for example from facsimile machines.

In a third embodiment the processing module 15 is realized as an information module, which is adapted to inform a user of the system about the intelligibility or unintelligibility of the acoustic signal. It is for example possible, that the audio signal generating means is a microphone and the information to the user is fed in to an indication lamp, like a traffic light, which is mechanically coupled or adjacent to the microphone, allowing a real-time feedback to the user, whether or not an announcement or speech was intelligible or not.

It shall be noted that two or all three embodiments may be realized in one system 1 as a further embodiment of the invention.

In a simple realization of the invention, the intelligibility measure is a value or a scalar. In more sophisticated realizations, the intelligibility measure may be realized as a vector or a multi-dimensional matrix.

It is for example possible, that a plurality of acoustic environments 3 are controlled or observed, so that the intelligibility measure is a vector, whereby each entry of the vector is allocated to a single acoustic environment 3. The acoustic environments 3 may refer to separated areas, for example rooms. Alternatively, the acoustic environments 3 may refer to a common area, for example a conference room or hall, whereby the system 1 secures that in any place of the common area the intelligibility is secured.

It is also possible, that the system 1 adapts the volume in different frequency bands separately to compensate for noise sources in certain frequency ranges separately. In this case the intelligibility measure is a vector, whereby each entry of the vector is allocated to a frequency band of the acoustic signal 6 or the audio signal 8. Optionally, the general or overall volume or energy level of the acoustic environment is kept lower while maintaining the intelligibility. This alternative could also cater for further increasing the intelligibility if a maximal gain level has been reached in other bands. This could however reduce the naturalness of the played message.

Furthermore it is possible to use the system 1 for a plurality of acoustic environments 3, whereby separate frequency bands are separately controlled, so that the intelligibility measure is a matrix.

Although the invention was illustrated by means of example by a public address system, the invention may also be used in other audio signal emitting systems like mobile phones, car stereos, television sets etc.

The invention claimed is:

1. A system for emitting an audio signal in an environment, the system comprising:

an audio source for providing the audio signal, at least one loudspeaker for emitting the audio signal, at least one microphone for receiving an acoustic signal from the environment, whereby the acoustic signal is based on the audio signal and may comprise disturbing components, an analyzing module for analyzing the acoustic signal and for providing an intelligibility measure from an objective intelligibility measure method whereby the intelligibility measure is used as a feedback signal, an automatic volume control having a control loop and that controls the volume or the energy of the audio signal emitted by the at least one loudspeaker using the intelligibility measure as the feedback signal in the control loop, and repeating module that repeats the audio signal in case the intelligibility measure is worse than a pre-defined value or threshold.

2. The system according to claim 1, wherein the analyzing module is adapted to analyze the acoustic signal with a delay smaller than 2 s and/or to provide the intelligibility measure in real-time.

3. The system according to claim 1, wherein the intelligibility measure is a characteristic for the speech intelligibility of the acoustic signal or that the intelligibility measure is a characteristic for the music intelligibility of the acoustic signal.

4. The system according to claim 1, wherein the analyzing module is adapted to compare the audio signal with the corresponding acoustic signal to derive the intelligibility measure.

5. The system according to claim 4, wherein the objective intelligibility measure is based on the comparison of the frequency distribution of the especially time aligned audio signal and the acoustic signal during a time period shorter than 2 s.

6. The system according to claim 1, wherein the analyzing module is adapted to provide the intelligibility measure for at least two different frequency bands of the acoustic signal and that the automatic volume control is adapted to control the volumes or energies of the frequency bands of the audio signal separately.

7. The system according to claim 6, wherein the automatic volume control is adapted to keep the overall energy of the audio signal in the environment constant or within a given range.

8. The system according to claim 1, further comprising a record module, which is adapted to record the intelligibility measure of the acoustic signal.

9. The system according to claim 1, further comprising an information module, which is adapted to inform a user of the system about the intelligibility measure or a representative or an equivalent thereof.

10. The system according to claim 1, configured as a public address system or as a sound reinforcement system.

11. The system according to claim 10, wherein the audio source comprises a speaker unit with a transducer, especially a microphone, and a visual indicator indicating the intelligibility measure or a representative or an equivalent thereof.

12. A method for controlling, correcting and/or indicating the intelligibility measure of an audio signal generated by a system according to claim 1, wherein the intelligibility measure is used as a feedback signal in the system.

13. The system according to claim 1, wherein the control loop of the automatic volume control is further adapted to compare the intelligibility measure to a plurality of thresholds to determine whether a gain of an amplifier needs to be increased, decreased, or kept constant to maintain a predefined intelligibility measure.

14. The system according to claim 13, wherein the gain of the amplifier is upper-bound and lower-bound to predetermined levels.

15. The system according to claim 1, further comprising a delay unit, wherein the delay unit is configured to time-align the audio signal and the acoustic signal.

16. The system according to claim 15, wherein the delay unit is configured to delay receipt of the audio signal at the analyzing module by 2 seconds or less.

17. The system according to claim 1, wherein the repeating module determines whether to repeat the audio signal based on an analysis of the intelligibility measure, wherein the analysis of the intelligibility measure includes determining whether a consecutive number of unintelligible frames included in the audio signal exceeds a predetermined threshold, and wherein the repeating module repeats the audio signal when the predetermined threshold is exceeded.

18. A system for emitting an audio signal in an environment, the system comprising:

an audio source for providing the audio signal, at least one loudspeaker for emitting the audio signal, at least one microphone for receiving an acoustic signal from the environment, whereby the acoustic signal is based on the audio signal and may comprise disturbing components, an analyzing module for analyzing the acoustic signal and for providing an intelligibility measure from an objective intelligibility measure method whereby the intelligibility measure is used as a feedback signal, an automatic volume control having a control loop and that controls the volume or the energy of the audio signal emitted by the at least one loudspeaker using the intelligibility measure as the feedback signal in the control loop, and a repeating module that repeats the audio signal in case the intelligibility measure is worse than a pre-defined value or threshold, wherein the repeating module determines whether to repeat the audio signal based on an analysis of the intelligibility measure, wherein the analysis of the intelligibility measure includes determining whether a total number of unintelligible frames included in the audio signal exceeds a predetermined threshold, and wherein the repeating module repeats the audio signal when the predetermined threshold is exceeded.

19. The system according to claim 1, wherein the repeating module is adapted to automatically repeat the audio signal or a substitute audio signal when the repeating module determines that the intelligibility measure is worse than the pre-defined value or threshold.

20. The system according to claim 6, wherein the automatic volume control uses the intelligibility measure for the at least two different frequency bands for controlling the volumes of the frequency bands of the audio signal independently from each other in order to compensate for noise sources in certain frequency ranges in the environment.

* * * * *